United States Patent [19]

Aoki et al.

[11] 4,309,560

[45] Jan. 5, 1982

[54] MODIFIER FOR FIBERS OR FIBROUS STRUCTURES

[75] Inventors: Kiyoshi Aoki, Hirakata; Saburo Ohara, Kyoto, both of Japan

[73] Assignees: Kanebo, Ltd., Tokyo; Kanebo Synthetic Fibers Ltd., Osaka, both of Japan

[21] Appl. No.: 161,717

[22] Filed: Jun. 20, 1980

[30] Foreign Application Priority Data

Nov. 26, 1979 [JP] Japan ..... 54-153268

[51] Int. Cl.[3] ..... C07C 143/525; C07C 69/80; C07C 69/82; C07C 69/593; C07C 69/60

[52] U.S. Cl. ..... 560/14; 427/393.1; 560/90; 560/199

[58] Field of Search ..... 560/199, 90, 14

[56] References Cited

U.S. PATENT DOCUMENTS

| | | | |
|---|---|---|---|
| 3,221,043 | 11/1965 | Fekete et al. | 560/90 |
| 3,336,361 | 8/1967 | Dill | 560/90 |
| 3,455,801 | 7/1969 | D'Alelio | 560/90 X |
| 3,455,802 | 7/1969 | D'Alelio | 560/90 X |
| 3,527,737 | 9/1970 | Masuhara et al. | 560/199 X |
| 3,785,849 | 1/1974 | Parker et al. | 560/90 X |
| 4,089,649 | 5/1978 | Mares et al. | 560/90 X |
| 4,150,216 | 4/1979 | Quack et al. | 560/14 X |

*Primary Examiner*—Natalie Trousof
*Assistant Examiner*—Vera C. Clarke
*Attorney, Agent, or Firm*—Blanchard, Flynn, Thiel, Boutell & Tanis

[57] ABSTRACT

A compound represented by the general formula

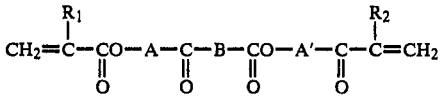

wherein $R_1$ and $R_2$ represent H or $CH_3$; A and A' represent

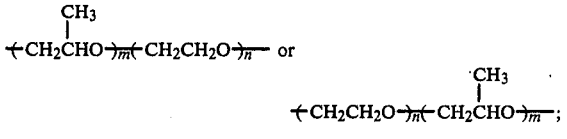

B represents

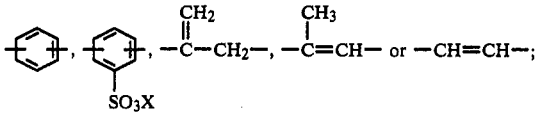

X represents H, $NH_4$ or an alkali metal; and m and n represent numerals determined by the following formulae, $0 \leqq m \leqq 25$, $5 \leqq n \leqq 50$ and $5 \leqq (m+n) \leqq 50$, can impart to fibers or fibrous structures durable excellent antistatic property, water absorption property, softness and pollution-resistant property in a simple heat treatment.

13 Claims, No Drawings

MODIFIER FOR FIBERS OR FIBROUS STRUCTURES

The present invention relates to a novel modifier capable of imparting durable excellent antistatic property, water absorption property, softness and pollution-resistant property to fibers or fibrous structures, and modified fibers or fibrous structures obtained by the use of the modifier.

It has been known to impart antistatic property, water absorption property and the like to hydrophobic fibers, such as polyester fibers, polyacrylonitrile fibers, polyamide fibers and the like, by applying a polymerizable hydrophilic monomer, such as acrylic acid, acrylamide, acrylamide derivative, polyalkylene glycol diacrylate, polyalkylene glycol diacrylate containing quaternary amine in its main chain, or the like, to the fibers, and polymerizing the monomer on the fiber surface to fix the resulting polymer thereto.

However, when these treating agents are used, the resulting fiber products have initially good antistatic property and water absorption property, but these properties are poor in the durability. Moreover, the treating agents have not sufficiently high affinity to the fibers, and further they must be generally used in combination with a catalyst. Therefore, a large amount of homopolymer is formed during the treatment, and hence a large amount of the treating agents are lost and the treated fibers are not uniform in the quality.

Recently, a treating agent consisting of polyalkylene glycol diacrylate having bisphenolic aromatic groups in its main chain has been disclosed in Japanese Patent Laid Open application No. 150,392/77. This treating agent can solve some of the above described drawbacks, but cannot impart sufficiently durable antistatic and water absorption properties to polyamide fibers and other fibers. That is, this treating agent is only effective to certain limited fibers. Further, this treating agent discolors during the treating of fibers or during the washing of the treated fibers to deteriorate the whiteness and sharpness of color of the fibers, and the quality of the treated fibers is very poor. Therefore, treating agents having a satisfactorily excellent property for the practical use have not yet been obtained.

The inventors have eagerly made broad and systematic investigations with respect to the relation between the molecular structure and the properties, such as durability, hydrophilic property, water absorption property, discoloration and the like, of modifier, and to the mechanism of imparting durable antistatic property, water absorption property, softness and pollution-resistant property to the fibers by the use of the modifier, and accomplished the present invention.

An object of the present invention is to provide a modifier capable of imparting durable excellent antistatic property, water absorption property, pollution-resistant property, and soft feeling to fibers or fibrous structures.

Another object of the present invention is to provide a modifier capable of producing modified fibers or fibrous structures having a high quality, which has never been attained, without discoloration during the modification treatment thereof, which modified fibers or fibrous structures are free from coloration during the storage.

A further object of the present invention is to provide a modifier, which has a high affinity to hydrophobic fibers, is able to be polymerized in the absence of catalyst without substantially forming into homopolymer, and is able to produce modified fibers or fibrous structures having a uniform property in a stable and simple treatment.

Another object of the present invention is to provide modified fibers or fibrous structures having the above described various excellent properties.

Other objects of the present invention will be apparent from the following detailed description.

That is, one of the features of the present invention is to provide a modifier for fibers or fibrous structures, which consists of a compound represented by the following general formula (I)

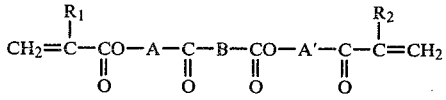

(I)

wherein $R_1$ and $R_2$ represents H or $CH_3$; A and A' represent

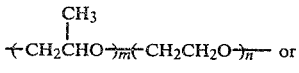

or

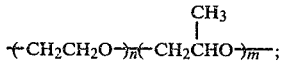

B represents

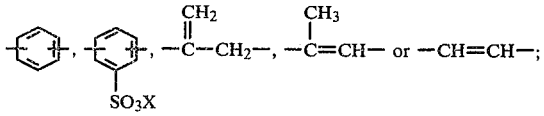

X represents H, $NH_4$ or an alkali metal; and m and n represent numerals determined by the following formulae, $0 \leqq m \leqq 25$, $5 \leqq n \leqq 50$ and $5 \leqq (m+n) \leqq 50$.

Another feature of the present invention is to provide modified fibers or fibrous structures obtained by applying a treating liquid containing a compound represented by the above described general formula (I) to fibers or fibrous structures, and heat treating the above treated fibers or fibrous structures.

The modifier represented by the above described general formula (I) contains thermally polymerizable vinyl groups at both ends of the molecular chain and in the molecular chain and further contains hydrophilic

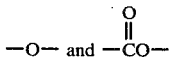

groups in the molecular chain. Therefore, when the modifier is applied to, for example, hydrophobic fibers, durable antistatic property and water absorption property can be imparted to the hydrophobic fibers. Further, the modifier is free from the discoloration during the treating of fibers or washing the treated fibers, which discoloration occurs always in the use of conventional treating agent containing bisphenolic aromatic rings, and therefore fiber products having a high quality can be obtained.

The modifier of the present invention can be easily obtained, for example, by reacting a dibasic acid or its derivative with a polyalkylene glycol in the presence of a catalyst according to a commonly known method, and then reacting the above obtained reaction product with acrylic acid or its derivative in the presence of a catalyst according to a commonly known method.

As the polyalkylene glycols, there can be used polyethylene glycol and a block copolymer of polyethylene glycol and polypropylene glycol. Among the polyalkylene glycols, polyalkylene glycol having a molecular weight of 300–3,000 is preferably used, and one having a molecular weight of 400–2,000, is particularly preferably used. When the molecular weight is lower than 300, the affinity of the resulting modifier to water is poor, and the fibers treated with the modifier are poor in the antistatic property, water absorption property and pollution-resistant property. While, when the molecular weight exceeds 3,000, the affinity of the resulting modifier to hydrophobic fibers is poor, and the amount of the modifier adhered to the fibers is small, and hence the treated fibers are poor in the color fastness to washing. That is, the use of polyalkylene glycol having a molecular weight of less than 300 or more than 3,000 cannot attain the object of the present invention and is not preferable.

The number of moles (n) of ethylene glycol residues is preferably larger than that (m) of propylene glycol residues in the polyalkylene glycol chain in view of the treating effect. Further, when the production efficiency is taken into consideration, it is preferable that all the alkylene glycol residues consist only of ethylene glycol residues.

As the dibasic acids and their derivatives, there can be used unsaturated dibasic acids and aromatic dibasic acids and their derivatives. The unsaturated dibasic acids and their derivatives include maleic acid, fumaric acid, itaconic acid and citraconic acid, and anhydrides, chlorides and esters of these acids. The aromatic dibasic acids and their derivatives include phthalic acid, isophthalic acid and terephthalic acid (preferably isophthalic acid and terephthalic acid), and derivatives and esters thereof. Further, as the derivatives of these phthalic acids, sulfonated phthalic acids, and ammonium and alkali metal salts of sulfonated phthalic acids are used, and among the alkali metal salts of sulfonated phthalic acids, sodium and potassium salts thereof are preferable.

As the acrylic acids and their derivatives, there can be used acrylic acid and methacrylic acid and their esters and chlorides. However, acrylic acid and its derivatives are somewhat superior to methacrylic acid and its derivatives in view of the antistatic property of the treated fibers.

The modifier according to the present invention can be applied to synthetic fibers, such as polyester fibers, polyamide fibers, polyacrylonitrile fibers, polyolefin fibers and the like; semi-synthetic fibers, such as triacetate and the like; and fibrous structures, such as yarns, woven fabrics, knitted fabrics, nonwoven fabrics, felt, carpet and the like, which consist of or contains the above described fibers.

The modifier of the present invention can be effectively applied to these various fibers, and can be particularly effectively applied to polyamide fibers and polyester fibers.

When the modifier of the present invention is applied to fibers, such as cotton, wool, silk, linen and the like, which have relatively high affinity to water, the antistatic property and water absorption property of these fibers can be of course improved.

The modifier of the present invention has a high affinity to the above described various fibers, and the polymerization reaction of the modifier proceeds easily on the fiber surface and in the vicinity of fiber surface not only in the presence of catalyst but also in the absence of catalyst, and therefore a dense and strong thin layer is formed on the fiber surface, and hence the treated fibers or fibrous structures have excellent softness and feeling and further have excellent durability in the antistatic property, water absorption property and pollution-resistant property. Moreover, the modifier is not substantially polymerized into homopolymer in the spaces between fibers or in the treating liquid, and therefore the loss of the modifier is very small.

The treatment of the above described fibers or fibrous structures with the modifier of the present invention is carried out in the following manner. Hereinafter, fibers or a fibrous structure to be treat may be referred to as a fibrous structure to be treated. A fibrous structure to be treated is applied with a treating liquid, such as aqueous solution, aqueous dispersion or the like, which contains the compound represented by the general formula (I), and the treated fibrous structure is heat treated.

As the means for applying the modifier to a fibrous structure and for heat treating the thus treated fibrous structure, there can be used an immersion heating method or a method, wherein a heat treatment is carried out after padding or spraying. In this case, it is important that the heat treatment is generally carried out under wet state in order to develop fully the property of the modifier of the present invention, that is, in order to agglomerate and deposite more effectively the modifier on the fiber surface and to form more effectively polymer layer on the deposited area, and the immersion heating method is particularly preferable. When the spray method or padding method is carried out, a steaming is carried out by means of a steamer or high-pressure steamer during the fibrous structure to be treated maintain its wet state after spraying or padding. In this case, the preliminarily drying or dry heat treatment affects adversely the durability of the antistatic, water absorption and pollution-resistant properties of the treated fibrous structure, and is not preferable. The heat treatment is preferably carried out under an inert gas atmosphere.

The use of catalyst for the polymerization of the modifier is not always necessary, and the heat treatment is generally and preferably carried out in the absence of catalyst in order to treat stably and uniformly a fibrous structure.

The heat treatment condition in the immersion heating method is as follows. A fibrous structure to be treated is immersed in a treating bath having a modifier concentration of 0.7–5% owf in a bath ratio of 1:5–1:100, preferably 1:5–1:80, and the bath is heated at a temperature range of 90°–160° C., preferably 100°–150° C., for 1–60 minutes, preferably 5–45 minutes, generally in the absence of catalyst. In this case, it is preferable that a fibrous structure to be treated is immersed in a treating bath at a relatively low temperature of from room temperature to 40° C. and then the bath is heated up to the above described treating temperature. As the result, the modifier can be adhered to the fibers in a high adhesion percentage. When a dyed fibrous structure is heat treated, if the treating temperature is excessively high, there is a risk of deterioration of the qualities of the fibrous structure, such as deterioration of color fastness, formation of color spots and the like. In this case, the fibrous structure is preferably treated at a relatively low temperature range of 100°-120° C.

The heat treatment condition in the spray method or padding method is as follows. A treating liquid having a modifier concentration of 1-10% by weight is generally applied to a fibrous structure to be treated in an amount that the adhered amount of the modifier to the fibrous structure will be at least 0.5%, calculated as solid content, based on the weight of the fibrous structure, and then the thus treated fibrous structure is heat treated under the same temperature and time conditions as those in the above described immersion heating method.

In any of the above described immersion heating method, spray method and padding method, it is preferable that the pH of the treating liquid is previously adjusted within a range of 7-1, preferably 6-3, in order to improve the adhesion of the modifier to the fibrous structure. Of course, the pH of the treating liquid is not limited to the above described range, but can be properly selected depending upon the kind and shape of fibrous structure to be treated, and further depending upon whether the fibrous structure has been dyed or not. As the acids to be used in the adjustment of pH, there can be used organic acids, such as acetic acid, formic acid, citric acid and the like; inorganic acids, such as sulfuric acid, phosphoric acid and the like; and derivatives of these organic and inorganic acids.

The above described treatments are carried out so that the modifier will be adhered to the fibrous structure in an amount of generally at least 0.5% by weight, preferably at least 0.7% by weight, more preferably at least 1.0% by weight, and most preferably at least 1.2% by weight, based on the weight of the fibers. When the adhered amount is less than 0.5% by weight, it is difficult to form uniform and strong thin layer of the modifier on the fiber surface, and the color fastness to washing of the treated fibers or fibrous structures is very poor and modified fibers or fibrous structures aimed in the present invention cannot be obtained.

As described above, according to the present invention, fibers or fibrous structures having highly durable antistatic property, water absorption property, pollution-resistant property and soft feeling can be obtained. Moreover, the modifier of the present invention does not discolor during the treatment of fibers or fibrous structures and during the washing of the treated fibers or fibrous structures, and therefore the modifier does not deteriorate the quality of the aimed fiber product. Moreover, the modifier is not substantially formed into homopolymer during the treatment of fibers or fibrous structures, and modified fibers or fibrous structures can be inexpensively obtained according to the present invention.

The following examples are given in illustration of the invention and are not intended as limitations thereof. In these examples, the measuring conditions of antistatic property (electrification voltage and half-life period), water absorption property, whiteness and color fastness to washing and the washing condition for the evaluation of durability are as follows.

Electrification voltage (v):

The electrification voltage is measured under an atmosphere kept at 20°±2° C. and 40±2% RH by using cotton shirting No. 3 as a rubbing cloth by means of a rotary static tester developed by the Chemical Institute of Kyoto University and made by Koa Shokai Co.

Half-life period (sec.):

The half-life period is measured under an applied voltage of 10 KV and under an atmosphere kept at 20°±2° C. and 40±2% RH by means of a Static Honestometer made by Shishido Shokai Co.

Water absorption property (cm):

This measurement is carried out according to JIS L-1079B method (water absorption rate B-method).

Color fastness to washing:

This measurement is carried out according to JIS L-0844 method.

Whiteness:

The whiteness is expressed by a reflectance (%) to a standard magnesium oxide at a wavelength of 450 mμ using a photoelectric spectrophotometer Model EPR-2 made by Hitachi Seisakusho Co.

Washing condition:

The sample is washed in a washing solution containing 0.1% by weight of a commercially available synthetic detergent (trademark: Pinky, made to Lion Oils and Fats Co.) by means of a domestic electric washing machine (full-automatic washer, Model FP-578, made by Hitachi Seisakusho Co.). A sample is washed at 40° C. for 10 minutes, rinsed at room temperature for 3 minutes by two times, and dehydrated. This cycle is repeated by 5 times.

Throughout the specification, the adhesion rate (%) is expressed by a value of B/A×100, wherein A is an amount of a modifier used (i.e. the total amount of modifier in a bath in an immersion method or the product of a treating concentration and a squeezing percentage in spraying and padding methods) and B is an amount of a modifier adhered to a sample.

EXAMPLE 1

A taffeta made of polyester fibers of 75 d/36 f was immersed in the following treating bath:

Modifier:

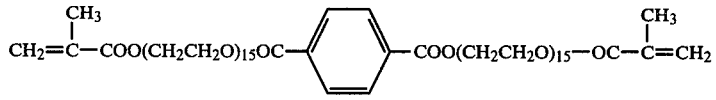

Concentration: 5% (owf)

pH: 5

Bath ratio: 1:20

After the bath temperature was raised to a predetermined temperature in 20-30 minutes, the immersion treatment was carried out under a heat treating condition as shown in the following Table 1.

After the immersion treatment, the polyester taffeta was soaped in a 0.1% by weight solution of a nonionic surfactant at 40° C. for 1 minute, washed with a warm water at 40° C. for 1 minute, washed with water and then dried in a warm air dryer at 40° C.

In this treatment, it has been confirmed that the adhesion rate is about 80% and most of the modifier is polymerized and bonded to the fibers without forming homopolymer in the bath.

The antistatic property and water absorption property were measured with respect to the treated taffeta to obtain a result as shown in Table 1. From the data of Table 1, it can be seen that the initial performances and durability are excellent. Moreover, the deterioration of whiteness was not observed in the treated taffeta.

TABLE 1

| Heat treating condition | Antistatic property: Electrification voltage (v) $W_0$ | $W_5$ | Half-life period (sec.) $W_0$ | $W_5$ | Water absorption property (cm) $W_0$ | $W_5$ |
|---|---|---|---|---|---|---|
| Untreated | 6,500 | 6,400 | 120< | 120< | 1.0 | 1.0 |
| 100° C. × 10 minutes | 750 | 810 | 5.7 | 5.8 | 7.4 | 7.2 |
| 110° C. × 10 minutes | 780 | 850 | 5.1 | 5.1 | 7.3 | 7.5 |
| 120° C. × 10 minutes | 780 | 840 | 5.1 | 5.2 | 7.5 | 7.5 |
| 130° C. × 10 minutes | 790 | 850 | 5.3 | 5.4 | 7.4 | 7.6 |
| 150° C. × 10 minutes | 810 | 910 | 5.3 | 5.4 | 7.6 | 7.5 |

(Note)
$W_0$: before washing,
$W_5$: after 5 times washing

EXAMPLE 2

The same polyester taffeta as described in Example 1 was immersed in the following treating bath:

Modifier:

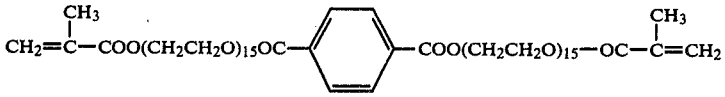

Concentration: 10 wt% pH: 5

Then, the taffeta was taken out from the bath and squeezed by a mangle (squeezing percentage: 50%). Immediately after the squeezing, the taffeta was subjected to a steaming under a condition of 100° C.×10 min. or 130° C.×10 min. and then washed in the same manner as described in Example 1 to obtain a treated taffeta. The properties of the thus treated taffeta are shown in the following Table 2.

TABLE 2

| Heat treating condition | Antistatic property: Electrification voltage (v) $W_0$ | $W_5$ | Half-life period (sec.) $W_0$ | $W_5$ | Water absorption property (cm) $W_0$ | $W_5$ |
|---|---|---|---|---|---|---|
| Untreated | 6,500 | 6,400 | 120< | 120< | 1.0 | 1.0 |
| 100° C. × 10 minutes | 800 | 880 | 5.3 | 5.0 | 7.0 | 7.2 |
| 130° C. × 10 minutes | 830 | 870 | 5.3 | 5.9 | 7.2 | 7.5 |

EXAMPLE 3

The same polyester taffeta was treated by using the following modifiers A-F in the same manner as described in Example 1, provided that the immersion heating condition is 120° C.×10 min.

A :

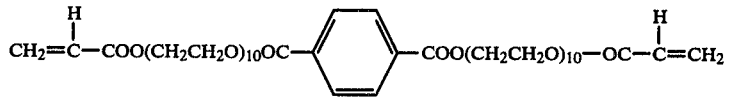

B :

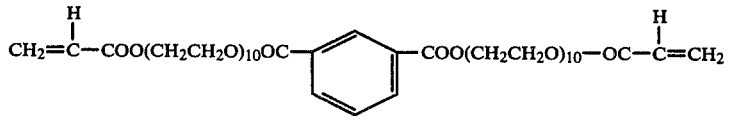

C :

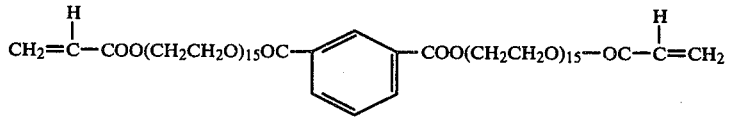

D :

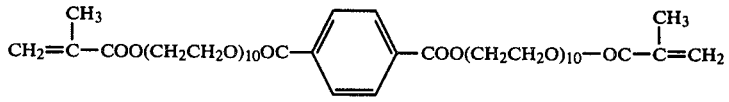

E :

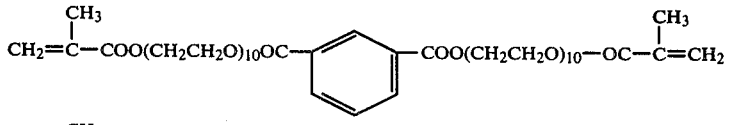

F :

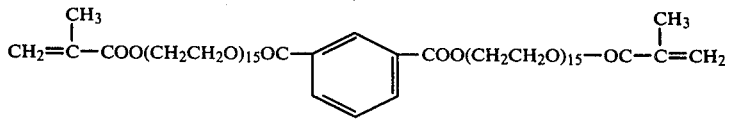

The antistatic property, water absorption property and whiteness of the thus treated taffeta are shown in the following Table 3. For the comparison, the same procedure as described above was repeated by using the following compound G instead of the modifier according to the invention to obtain a result as shown in Table 3.

G :

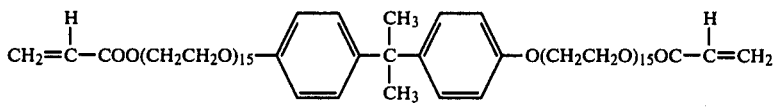

TABLE 3

| | Compound | Antistatic property: Electrification voltage (v) $W_0$ | $W_5$ | Half-life period (sec.) $W_0$ | $W_5$ | Water absorption property (cm) $W_0$ | $W_5$ | Whiteness $W_0$ | $W_5$ |
|---|---|---|---|---|---|---|---|---|---|
| Untreated | — | 6,500 | 6,400 | 120< | 120< | 1.0 | 1.0 | 85 | 84 |
| | A | 810 | 920 | 5.5 | 5.8 | 7.1 | 7.0 | 84 | 81 |
| | B | 800 | 850 | 5.4 | 5.4 | 7.0 | 6.9 | 84 | 82 |
| Present | C | 790 | 870 | 5.3 | 5.8 | 6.9 | 7.3 | 84 | 81 |
| invention | D | 820 | 860 | 5.5 | 5.7 | 7.4 | 7.6 | 84 | 81 |
| | E | 900 | 880 | 5.5 | 5.8 | 7.5 | 7.2 | 84 | 82 |
| | F | 850 | 890 | 5.5 | 5.7 | 7.3 | 7.1 | 84 | 82 |
| Comparative example | G | 810 | 880 | 5.9 | 6.2 | 5.0 | 5.2 | 76 | 70 |

As apparent from Table 3, the modifier according to the invention makes it possible to give excellent durable antistatic property and water absorption property to the treated taffeta and the deterioration of whiteness is not observed. On the other hand, in the compound having a bisphenolic aromatic ring in its main chain (comparative example), the coloration by the treatment and washing (deterioration of whiteness) is conspicuous and the water absorption property is not always sufficient. From the above, it is apparent that the modifier according to the invention establishes superiority over the conventionally used modifier.

EXAMPLE 4

A taffeta made of polyester fibers of 75 d/36 f was colored into a navy blue with a disperse dye in the usual manner and immersed in the following treating bath:

Modifier:

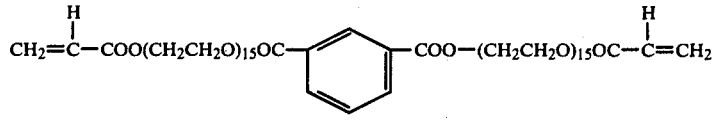

Concentration: 5% (owf)

pH: 5

Bath ratio: 1:20

Then, the immersion treatment was carried out under a heat treating condition as shown in the following Table 4 and thereafter the same procedure as described in Example 1 was repeated to obtain a treated taffeta.

The antistatic property, water absorption property and color fastness (color fastness to washing) of the thus treated taffeta were measured to obtain a result as shown in Table 4.

TABLE 4

| Heat treating condition | Antistatic property: Electrification voltage (v) $W_0$ | $W_5$ | Half-life period (sec.) $W_0$ | $W_5$ | Water absorption property (cm) $W_0$ | $W_5$ | Color fastness to washing (grade) $W_0$ |
|---|---|---|---|---|---|---|---|
| Untreated | 6,200 | 5,900 | 120< | 120< | 1.0 | 1.0 | 4.0 |
| 100° C. × 10 minutes | 850 | 950 | 5.5 | 5.9 | 7.3 | 7.1 | 4.0 |
| 110° C. × 10 minutes | 920 | 960 | 5.5 | 6.3 | 7.2 | 7.0 | 4.0 |
| 120° C. × 10 minutes | 900 | 950 | 5.4 | 6.5 | 7.0 | 6.9 | 4.0 |

EXAMPLE 5

The same procedure as described in Example 1 was repeated by using a compound of the following general formula

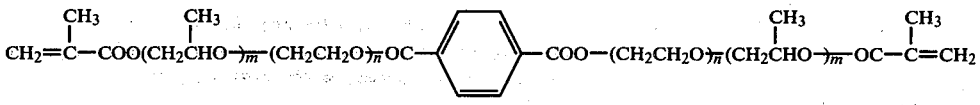

wherein numerical values of m and n are shown in the following Table 5 as a modifier, provided that the immersion treatment was carried out under a condition of 120° C.×10 min. The properties of the thus treated taffeta are also shown in Table 5.

TABLE 5

| Compound (m:n) | Antistatic property: Electrification voltage (v) $W_0$ | $W_5$ | Half-life period (sec.) $W_0$ | $W_5$ | Water absorption property (cm) $W_0$ | $W_5$ |
|---|---|---|---|---|---|---|
| 0:25 | 650 | 1,200 | 3.2 | 7.0 | 7.8 | 6.5 |
| 0:15 | 780 | 840 | 5.1 | 5.2 | 7.5 | 7.5 |
| 3:12 | 850 | 950 | 6.2 | 6.5 | 7.0 | 7.0 |
| 5:10 | 1,000 | 1,200 | 7.8 | 8.5 | 6.0 | 6.0 |
| 0:7 | 950 | 1,100 | 6.5 | 7.8 | 6.0 | 5.8 |

EXAMPLE 6

A taffeta made of polyamide fibers of 70 d/18 f was immersed in the following treating bath:

Modifier:

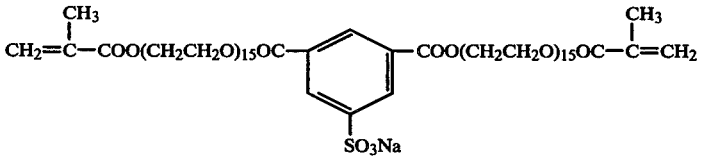

Concentration: 5% (owf)

pH: 5

Bath ratio: 1:20 and then the bath temperature was raised from room temperature to a predetermined temperature in 20–30 minutes, and thereafter the immersion treatment was carried out under a heat treating condition as shown in the following Table 6. Subsequently, the same procedure as described in Example 1 was repeated to obtain a treated taffeta.

In this treatment, there was not observed the formation of homopolymer in the bath and the resulting treated taffeta had a soft and favorable feeling and substantially the same whiteness as in the untreated taffeta.

As a result of evaluating the antistatic property and water absorption property of the treated taffeta, it can be seen from Table 6 that the initial performances and durability are excellent.

TABLE 6

| Heat treating condition | Antistatic property: Electrification voltage (v) $W_0$ | $W_5$ | Half-life period (sec.) $W_0$ | $W_5$ | Water absorption property (cm) $W_0$ | $W_5$ |
|---|---|---|---|---|---|---|
| 100° C. × 10 minutes | 800 | 1,100 | 5.4 | 7.3 | 8.1 | 6.5 |
| 110° C. × 10 minutes | 600 | 1,000 | 4.5 | 7.2 | 8.1 | 7.1 |
| 120° × 10 minutes | 650 | 1,000 | 5.1 | 7.5 | 8.2 | 7.5 |
| 130° C. × 10 minutes | 600 | 1,000 | 4.8 | 7.1 | 8.3 | 7.4 |
| 130° C. × 10 minutes | 600 | 1,000 | 4.8 | 7.1 | 8.3 | 7.4 |
| 150° C. × 10 minutes | 600 | 1,100 | 5.1 | 7.0 | 7.8 | 7.4 |
| Untreated | 10,000 | 10,000 | 120< | 120< | 1.5 | 1.5 |

EXAMPLE 7

The same procedure as described in Example 6 was repeated, except that the pH of the treating bath was adjusted to 7, 5, 3 or 1, whereby a treated taffeta was obtained. In this case, the immersion treatment was carried out under a heating condition of 120° C.×10 min. The properties of the thus treated taffeta are shown in the following Table 7.

TABLE 7

| pH | Antistatic property: Electrification voltage (v) $W_0$ | $W_5$ | Half-life period (sec.) $W_0$ | $W_5$ | Water absorption property (cm) $W_0$ | $W_5$ |
|---|---|---|---|---|---|---|
| 7 | 600 | 1,000 | 4.7 | 6.5 | 7.8 | 7.2 |
| 5 | 700 | 1,100 | 4.4 | 6.5 | 7.5 | 7.3 |
| 3 | 700 | 1,000 | 4.3 | 6.3 | 7.5 | 7.1 |
| 1 | 600 | 1,100 | 4.8 | 5.9 | 8.1 | 7.1 |
| Untreated | 10,000< | 10,000< | 120< | 120< | 1.5 | 1.5 |

EXAMPLE 8

The same polyamide taffeta as described in Example 6 was immersed in the following treating bath:

Modifier:

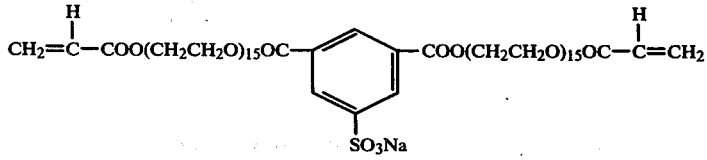

Concentration: 10 wt% pH: 5 and then the taffeta was taken out from the bath and squeezed by a mangle (squeezing percentage: 50%). Immediately after the squeezing, the taffeta was subjected to a steaming under a condition of 100° C.×10 min. or 130° C.×10 min. and then washed and dried in the same manner as described in Example 1 to obtain a treated taffeta.

For the comparison, the same procedure as described above was repeated by using a compound of the following formula

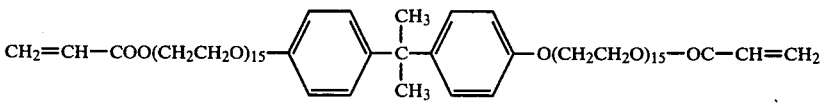

as a modifier (comparative example).

The antistatic property and water absorption property of the thus treated taffeta were measured to obtain a result as shown in the following Table 8.

TABLE 8

| | Heat treating condition | Antistatic property: Electrification voltage (v) $W_0$ | $W_5$ | Half-life period (sec.) $W_0$ | $W_5$ | Water absorption property (cm) $W_0$ | $W_5$ |
|---|---|---|---|---|---|---|---|
| Present invention | 100° C. × 10 minutes | 650 | 1,100 | 5.5 | 6.7 | 7.5 | 6.8 |
| | 130° C. × 10 minutes | 700 | 1,100 | 5.3 | 7.0 | 7.5 | 7.0 |
| Comparative example | 130° C. × 10 minutes | 1,500 | 3,500 | 95 | 120< | 6.0 | 4.5 |
| | Untreated | 10,000< | 10,000< | 120< | 120< | 1.5 | 1.5 |

From the result of Table 8, it can be seen that the modifier according to the invention gives fairly excellent antistatic property and water absorption property to the polyamide fiber as compared with the conventionally known modifier having a bisphenolic aromatic ring.

EXAMPLE 9

A taffeta made of polyester fibers of 75 d/36 f was immersed in the same treating bath as described in Example 6, except that each of the following compounds A-D (present invention) and E (comparative example) was used as a modifier.

A:

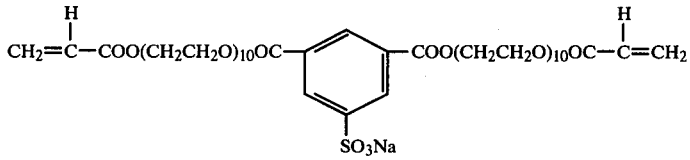

B:

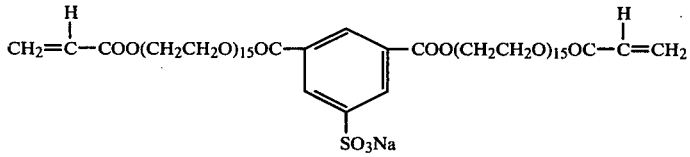

C:

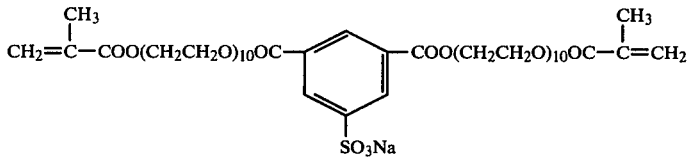

D:

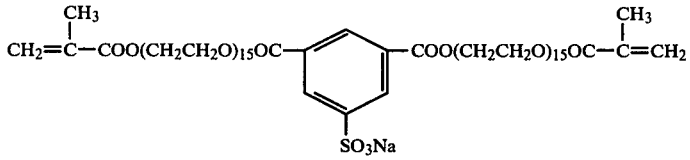

E:

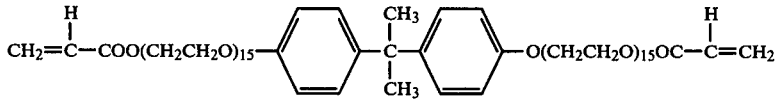

After the bath temperature was raised from room temperature to a predetermined temperature in about 30 minutes, the immersion treatment was carried out under a condition of 120° C.×10 min. and then the same procedure as described in Example 1 was repeated to obtain a treated taffeta having properties as shown in the following Table 9.

TABLE 9

| | Modifier | Antistatic property: Electrification voltage (v) $W_0$ | $W_5$ | Half-life period (sec.) $W_0$ | $W_5$ | Water absorption property (cm) $W_0$ | $W_5$ | Whiteness $W_0$ | $W_5$ |
|---|---|---|---|---|---|---|---|---|---|
| Present invention | A | 550 | 820 | 4.2 | 6.0 | 7.5 | 7.2 | 84 | 82 |
| | B | 560 | 840 | 4.2 | 5.9 | 7.6 | 7.5 | 84 | 82 |
| | C | 580 | 900 | 4.4 | 5.9 | 7.6 | 7.5 | 84 | 81 |
| | D | 580 | 920 | 4.5 | 6.0 | 7.5 | 7.6 | 84 | 81 |
| Comparative example | E | 610 | 880 | 4.4 | 6.2 | 5.0 | 5.2 | 76 | 70 |
| Untreated | | 6,500 | 6,400 | 120< | 120< | 1.0 | 1.0 | 85 | 84 |

As apparent from Table 9, the modifier according to the invention imparts excellent antistatic property and water absorption property and does not substantially exhibit the deterioration of whiteness. On the contrary, in the conventional modifier having a bisphenolic aromatic ring in its main chain (comparative example), the antistatic property is substantially equal to that of the invention, but the water absorption property is fairly poor and the deterioration of whiteness in the treatment or washing is conspicuous. From this fact, it is apparent that the modifier according to the invention establishes superiority over the conventional modifier.

EXAMPLE 10

A taffeta made of polyamide fibers of 70 d/18 f was colored into a navy blue with an acid dye in the usual manner and then subjected to an immersion treatment in the same manner as described in Example 6, except that the heat treating condition was 100° C.×10 min., 110° C.×10 min. or 120° C.×10 min.

The properties of the thus treated taffeta are shown in the following Table 10.

TABLE 10

| Heat treating condition | Antistatic property: Electrification voltage (v) $W_0$ | $W_5$ | Half-life period (sec.) $W_0$ | $W_5$ | Water absorption property (cm) $W_0$ | $W_5$ | Color fastness to washing (grade) |
|---|---|---|---|---|---|---|---|
| 100° C. × 10 minutes | 600 | 1,000 | 4.5 | 6.5 | 7.8 | 7.5 | 4.0 |
| 110° C. × 10 minutes | 600 | 1,100 | 4.8 | 7.1 | 8.2 | 7.4 | 4.0 |
| 120° C. × 10 minutes | 600 | 1,100 | 4.6 | 7.1 | 8.0 | 7.5 | 4.0 |
| Untreated | 10,000< | 10,000< | 120< | 120< | 1.5 | 1.5 | 4.0 |

EXAMPLE 11

A taffeta made of polyester fibers of 75 d/36 f was immersed in the following treating bath:

Modifier a:

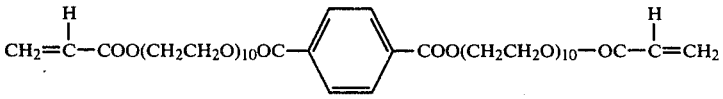

Modifier b:

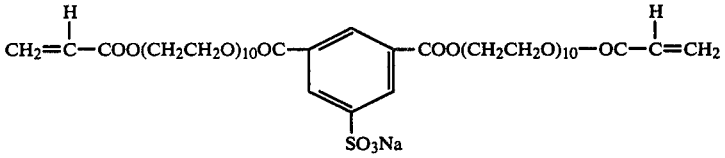

Mixing ratio: weight ratio of solid contents a and b shown in the following Table 11

Concentration: 5% (owf)

pH: 5

Bath ratio: 1:20

After the bath temperature was raised from room temperature to a predetermined temperature in about 30 minutes, the immersion treatment was carried out under a heat treating condition of 120° C.×10 min. After the immersion treatment, the taffeta was taken out from the bath, washed with a warm water at 40° C. for 1 minute, washed with water and then dried in a warm air dryer at 40° C.

The antistatic property and water absorption property of the thus treated taffeta were measured to obtain a result as shown in Table 11.

In this treatment, it has been confirmed that most of the modifiers are polymerized and bonded to the surfaces of the polyester fibers without forming homopolymer in the bath.

TABLE 11

| Mixing ratio (a:b) | Antistatic property: Electrification voltage (v) $W_0$ | $W_5$ | Half-life period (sec.) $W_0$ | $W_5$ | Water absorption property (cm) $W_0$ | $W_5$ |
|---|---|---|---|---|---|---|
| 100:0 | 810 | 920 | 5.5 | 5.8 | 7.1 | 7.0 |
| 95:5 | 660 | 720 | 5.2 | 5.5 | 7.5 | 7.5 |
| 90:10 | 610 | 630 | 4.6 | 4.8 | 8.0 | 8.0 |
| 70:30 | 560 | 580 | 4.0 | 4.2 | 8.0 | 8.0 |
| 50:50 | 570 | 590 | 4.2 | 4.2 | 8.2 | 8.0 |
| 30:70 | 550 | 560 | 4.1 | 4.3 | 8.0 | 7.8 |
| 10:90 | 560 | 580 | 4.0 | 4.1 | 8.0 | 7.8 |
| 5:95 | 550 | 680 | 4.1 | 4.5 | 7.7 | 7.4 |
| 0:100 | 550 | 820 | 4.2 | 6.0 | 7.5 | 7.2 |
| Untreated | 6,500 | 6,400 | 120< | 120< | 1.0 | 1.0 |

EXAMPLE 12

The same polyester taffeta as described in Example 1 was immersed in a treating bath containing a mixture of modifiers c and d with a mixing ratio of 90:10

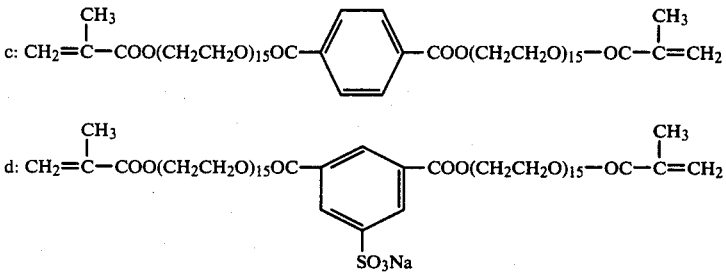

and having a concentration shown in the following Table 12, a pH of 5 and a bath ratio of 1:20, and then the immersion treatment, washing and drying were carried out in the same manner as described in Example 11 to obtain a treatment taffeta having a different amount of the modifiers adhered to the polyester fibers. The properties of the thus treated taffeta are also shown in Table 12. From the result of Table 12, it can be seen that when the amount of modifier adhered to the fibers is less than 0.5%, the washing durability is apt to be deteriorated.

TABLE 12

| Concentration (% owf) | Amount of modifier adhered (wt% per fibers) | Antistatic property: Electrification voltage (v) $W_0$ | $W_5$ | Half-life period (sec.) $W_0$ | $W_5$ | Water absorption property (cm) $W_0$ | $W_5$ |
|---|---|---|---|---|---|---|---|
| 0.5 | 0.38 | 780 | 1,020 | 5.3 | 7.5 | 7.5 | 6.3 |
| 0.7 | 0.55 | 710 | 730 | 4.4 | 4.6 | 8.0 | 7.9 |
| 1.0 | 0.80 | 600 | 630 | 4.2 | 4.3 | 8.0 | 7.9 |
| 3.0 | 2.20 | 590 | 640 | 4.1 | 4.4 | 8.5 | 8.1 |
| 5.0 | 3.50 | 610 | 650 | 4.2 | 4.3 | 8.3 | 8.1 |
| Untreated | | 6,500 | 6,400 | 120< | 120< | 1.0 | 1.0 |

EXAMPLE 13

A taffeta made of polyester fibers of 75 d/36 f was subjected to an immersion heat treatment in the same manner as described in Example 11 except that the following compounds (I) and (II) were used in a combination shown in the following Table 13 with a mixing ratio of 70:30 as a modifier.

Compound (I):

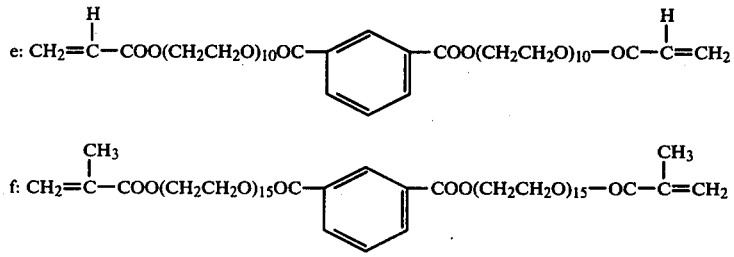

Compound (II):

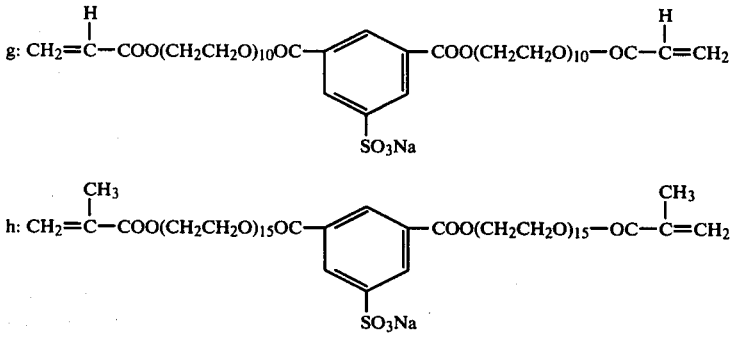

The antistatic property and water absorption property of the thus treated taffeta are also shown in Table 13.

TABLE 13

| Modifier | | Antistactic property | | | | Water absorption property (cm) | |
|---|---|---|---|---|---|---|---|
| | | Electrification voltage (v) | | Half-life period (sec.) | | | |
| Compound (I) | Compound (II) | $W_0$ | $W_5$ | $W_0$ | $W_5$ | $W_0$ | $W_5$ |
| e | g | 410 | 490 | 4.5 | 4.5 | 8.2 | 8.2 |
| " | h | 440 | 520 | 4.5 | 4.5 | 8.2 | 7.8 |
| f | g | 410 | 520 | 4.2 | 4.3 | 8.2 | 8.0 |
| " | h | 410 | 490 | 4.0 | 4.5 | 8.4 | 8.2 |
| Untreated | | 6,500 | 6,400 | 120< | 120< | 1.0 | 1.0 |

EXAMPLE 14

A taffeta made of polyamide fibers of 70 d/18 f was immersed in the following treating bath:

Modifier:

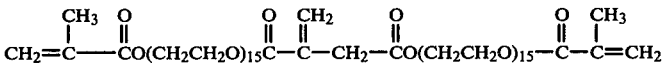

Concentration: 5 wt% pH: 5

Then, the taffeta was taken out from the bath and squeezed by a mangle (squeezing percentage: 100%).

Immediately after the squeezing, the taffeta was treated under a heat treating condition as shown in the following Table 14. Then, the same procedure as described in Example 1 was repeated to obtain a treated taffeta.

In this treatment, it has been confirmed that the adhesion rate is about 80% and most of the modifier is polymerized and bonded to the polyamide fibers.

The antistatic property and water absorption property of the thus treated taffeta were measured to obtain a result as shown in Table 14. From the result of Table 14, it can be seen that the initial performances and durability are excellent. Furthermore, the deterioration of whiteness was not observed in the treated taffeta.

TABLE 14

| Heat treating condition | Antistatic property | | | | Water absorption property (cm) | |
|---|---|---|---|---|---|---|
| | Electrification voltage (v) | | Half-life period (sec.) | | | |
| | $W_0$ | $W_5$ | $W_0$ | $W_5$ | $W_0$ | $W_5$ |
| Steaming × 5 minutes | 820 | 2,500 | 5.5 | 1.5 | 8.5 | 4.5 |
| Steaming × 10 minutes | 820 | 1,100 | 5.5 | 7.0 | 8.5 | 8.5 |
| Steaming × 20 minutes | 820 | 1,100 | 5.6 | 6.5 | 8.5 | 8.6 |
| Steaming × 30 minutes | 820 | 1,100 | 5.6 | 6.5 | 8.7 | 8.8 |
| Steaming × 60 minutes | 820 | 1,100 | 5.5 | 7.0 | 8.7 | 8.5 |
| Untreated | 10,000 | 10,000 | 120< | 120< | 1.5 | 1.5 |

EXAMPLE 15

A taffeta made of polyester fibers of 75 d/36 f was treated in the same manner as described in Example 14 to obtain a treated taffeta. The properties of the thus treated taffeta are shown in the following Table 15.

TABLE 15

| Heat treating condition | Antistatic property | | | | Water absorption property (cm) | |
|---|---|---|---|---|---|---|
| | Electrification voltage (v) | | Half-life period (sec.) | | | |
| | $W_0$ | $W_5$ | $W_0$ | $W_5$ | $W_0$ | $W_5$ |
| Steaming × 5 minutes | 780 | 900 | 5.5 | 7.2 | 8.0 | 6.5 |
| Steaming × 10 minutes | 780 | 850 | 5.7 | 6.0 | 8.1 | 8.0 |
| Steaming × 20 minutes | 760 | 850 | 5.7 | 6.0 | 7.8 | 8.0 |
| Steaming × 30 minutes | 790 | 870 | 5.5 | 5.8 | 7.8 | 8.2 |
| Steaming × 60 minutes | 760 | 870 | 5.4 | 5.8 | 8.0 | 8.0 |
| Untreated | 6,500 | 6,600 | 120< | 120< | 1.0 | 1.0 |

EXAMPLE 16

The same polyamide taffeta as described in Example 14 was immersed in the following treating bath:

Modifier:

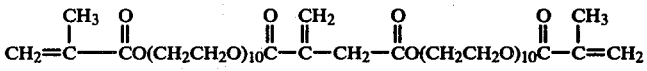

Concentration: 5% (owf)

pH: 5

Bath ratio: 1:20

After the bath temperature was raised to a predetermined temperature in 25 minutes, the immersion treatment was carried out under a heat treating condition as shown in the following Table 16. Then, the same procedure as described in Example 1 was repeated to obtain a treated taffeta.

The properties of the thus treated taffeta are also shown in Table 16.

TABLE 16

| Heat treating condition | Antistatic property | | | | Water absorption property (cm) | |
|---|---|---|---|---|---|---|
| | Electrification voltage (v) | | Half-life period (sec.) | | | |
| | $W_0$ | $W_5$ | $W_0$ | $W_5$ | $W_0$ | $W_5$ |
| 100° C. × 10 minutes | 820 | 1,200 | 5.7 | 6.5 | 8.3 | 8.0 |
| 100° C. × 20 minutes | 830 | 1,100 | 5.7 | 6.5 | 8.5 | 8.5 |
| 100° C. × 30 minutes | 830 | 1,200 | 5.5 | 6.5 | 8.5 | 8.5 |
| 100° C. × 60 minutes | 820 | 1,100 | 5.5 | 6.5 | 8.5 | 8.5 |
| Untreated | 10,000 | 10,000 | 120< | 120< | 1.5 | 1.5 |

EXAMPLE 17

The same polyester taffeta as described in Example 15 was immersed in the following treating bath:

Modifier:

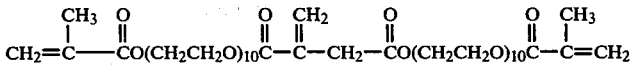

Concentration: 5% (owf)
pH: 5
Bath ratio: 1:20

After the bath temperature was raised to a predetermined temperature in 25 minutes, the immersion treatment was carried out under a heat treating condition as shown in the following Table 17. Then, the same procedure as described in Example 1 was repeated to obtain a treated taffeta.

The properties of the thus treated taffeta are also shown in Table 17.

TABLE 17

| Heat treating condition | Antistatic property: Electrification voltage (v) | | Antistatic property: Half-life period (sec.) | | Water absorption property (cm) | |
|---|---|---|---|---|---|---|
| | $W_0$ | $W_5$ | $W_0$ | $W_5$ | $W_0$ | $W_5$ |
| 100° C. × 10 minutes | 770 | 860 | 5.8 | 5.9 | 7.8 | 7.5 |
| 110° C. × 10 minutes | 780 | 850 | 5.7 | 5.8 | 7.6 | 7.5 |
| 120° C. × 10 minutes | 780 | 860 | 5.7 | 5.7 | 7.6 | 7.8 |
| 130° C. × 10 minutes | 760 | 850 | 5.5 | 5.6 | 7.8 | 7.7 |
| 150° C. × 10 minutes | 780 | 850 | 5.7 | 5.5 | 7.6 | 7.7 |
| Untreated | 6,500 | 6,600 | 120< | 120< | 1.0 | 1.0 |

EXAMPLE 18

The same polyamide taffeta as described in Example 14 was immersed in the following treating bath:

Modifier:

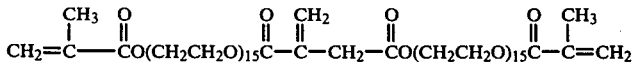

Concentration: 5 wt%
pH: 5

After the taffeta was squeezed by a mangle (squeezing percentage: 100%), the heat treatment was carried out under a condition as shown in the following Table 18. Then, the same procedure as described in Example 1 was repeated to obtain a treated taffeta.

The properties of the thus treated taffeta are also shown in Table 18.

TABLE 18

| Heat treating condition (Preliminary drying:Heat treatment | Antistatic property: Electrification voltage (v) | | Antistatic property: Half-life period (sec.) | | Water absorption property (cm) | |
|---|---|---|---|---|---|---|
| | $W_0$ | $W_5$ | $W_0$ | $W_5$ | $W_0$ | $W_5$ |
| 100° C. × 5 min.:150° C. × 0 min. | 820 | 2,500 | 5.7 | 1.5 | 8.5 | 5.8 |
| 100° C. × 5 min.:150° C. × 5 min. | 800 | 1,200 | 5.6 | 6.5 | 8.5 | 8.4 |
| 100 ° C. × 5 min.:150° C. × 10 min. | 820 | 1,100 | 5.5 | 6.5 | 8.8 | 8.6 |
| Untreated | 10,000 | 10,000 | 120< | 120< | 1.5 | 1.5 |

EXAMPLE 19

The same procedure as described in Example 14 was repeated, except that each of the following compounds A-D was used as a modifier and the heat treating time was 20 minutes, to obtain a treated taffeta.

Modifier:

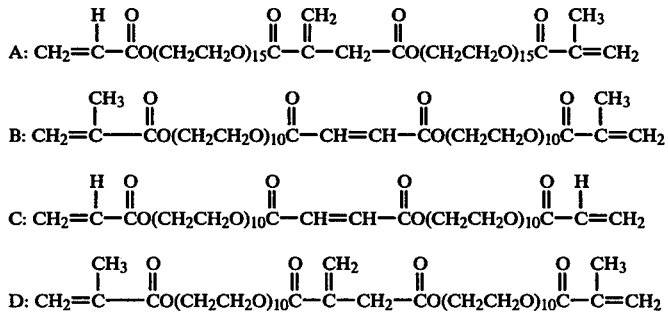

The antistatic property and water absorption property of the thus treated taffeta are shown in the following Table 19.

TABLE 19

| Modifier | Antistatic property: Electrification voltage (v) | | Antistatic property: Half-life period (sec.) | | Water absorption property (cm) | |
|---|---|---|---|---|---|---|
| | $W_0$ | $W_5$ | $W_0$ | $W_5$ | $W_0$ | $W_5$ |
| A | 820 | 1,100 | 5.5 | 6.5 | 8.5 | 8.4 |
| B | 840 | 1,200 | 5.6 | 7.0 | 8.5 | 8.5 |
| C | 830 | 1,200 | 5.6 | 6.5 | 8.4 | 8.5 |
| D | 820 | 1,100 | 5.5 | 6.5 | 8.7 | 8.5 |
| Untreated | 10,000 | 10,000 | 120< | 120< | 1.5 | 1.5 |

From the result of Table 19, it can be seen that the modifier according to the invention imparts excellent durable antistatic property and water absorption property.

What is claimed is:

1. A modifier for fibers or fibrous structures, which consists of a compound represented by the general formula (I)

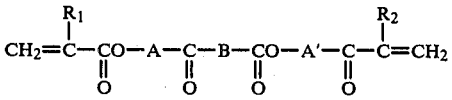

(I)

wherein $R_1$ and $R_2$ represent H or $CH_3$; A and A' represent

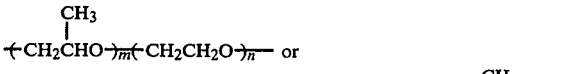

B represents

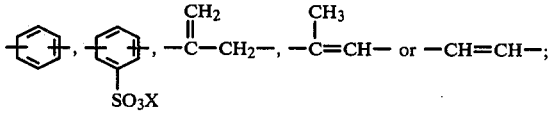

X represents H, $NH_4$ or an alkali metal; and m and n represent numerals determined by the following formulae, $0 \leqq m \leqq 25$, $5 \leqq n \leqq 50$ and $5 \leqq (m+n) \leqq 50$.

2. A modifier according to claim 1, wherein the number of repeating units (n) of ethylene glycol residues is larger than the number of repeating units (m) of propylene glycol residues.

3. A modifier according to claim 1 or 2, which is represented by the general formula:

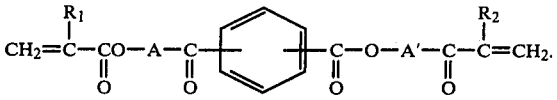

4. A modifier according to claim 3, which is represented by the general formula:

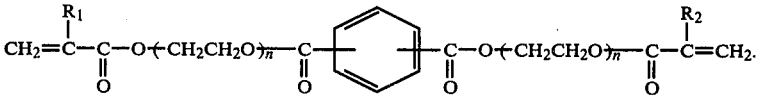

5. A modifier according to claim 4, which is represented by the general formula:

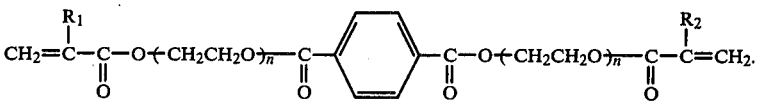

6. A modifier according to claim 4, which is represented by the general formula:

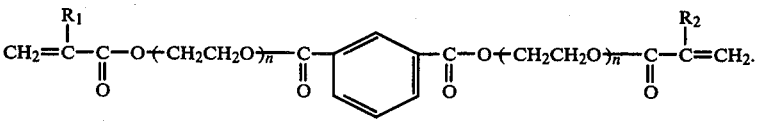

7. A modifier according to claim 1 or 2, which is represented by the general formula:

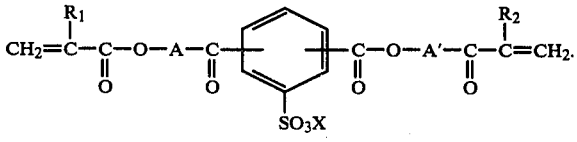

8. A modifier according to claim 7, which is represented by the general formula:

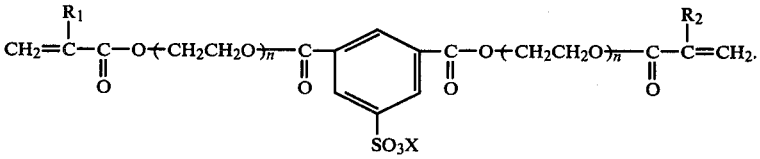

9. A modifier according to claim 7, wherein said X represents H, Na or K.

10. A modifier according to claim 1 or 2, which is represented by the general formula:

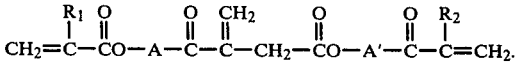

11. A modifier according to claim 10, which is represented by the general formula:

$$CH_2{=}\overset{R_1}{\overset{|}{C}}{-}\overset{O}{\overset{\|}{C}}O{-}(CH_2CH_2O)_n{-}\overset{O}{\overset{\|}{C}}{-}\overset{CH_2}{\overset{\|}{C}}{-}CH_2{-}\overset{O}{\overset{\|}{C}}O{-}(CH_2CH_2O)_n{-}\overset{O}{\overset{\|}{C}}{-}\overset{R_2}{\overset{|}{C}}{=}CH_2.$$

12. A modifier according to claim 1 or 2, which is represented by the general formula:

$$CH_2{=}\overset{R_1}{\overset{|}{C}}{-}\overset{O}{\overset{\|}{C}}O{-}A{-}\overset{O}{\overset{\|}{C}}{-}CH{=}CH{-}\overset{O}{\overset{\|}{C}}O{-}A'{-}\overset{O}{\overset{\|}{C}}{-}\overset{R_2}{\overset{|}{C}}{=}CH_2.$$

13. A modifier according to claim 12, which is represented by the general formula:

$$CH_2{=}\overset{R_1}{\overset{|}{C}}{-}\overset{O}{\overset{\|}{C}}O{-}(CH_2CH_2O)_n{-}\overset{O}{\overset{\|}{C}}{-}CH{=}CH{-}\overset{O}{\overset{\|}{C}}O{-}(CH_2CH_2O)_n{-}\overset{O}{\overset{\|}{C}}{-}\overset{R_2}{\overset{|}{C}}{=}CH_2.$$

* * * * *